US006155236A

United States Patent [19]

Jehle et al.

[11] Patent Number: 6,155,236

[45] Date of Patent: Dec. 5, 2000

[54] FUEL INJECTION NOZZLE INJECTING ONTO THE COMBUSTION SPACE OF AN INTERNAL COMBUSTION ENGINE

[75] Inventors: Erich Jehle, Stuttgart; Rolf Kusterer, Fellbach; Bernhard Schwarzkopf, Waldstetten, all of Germany

[73] Assignee: DaimlerChrysler AG, Stuttgart, Germany

[21] Appl. No.: 09/384,026

[22] Filed: Aug. 26, 1999

[30] Foreign Application Priority Data

Aug. 26, 1998 [DE] Germany ..... 198 38 748

[51] Int. Cl.[7] ..... F02M 37/04

[52] U.S. Cl. ..... 123/470; 123/41.31

[58] Field of Search ..... 123/470, 509, 123/510, 468, 469, 472, 541, 41.31

[56] References Cited

U.S. PATENT DOCUMENTS

| | | | |
|---|---|---|---|
| 3,125,078 | 3/1964 | Reiners | 123/470 |
| 3,334,617 | 8/1967 | Palkowsky | 123/470 |
| 3,841,277 | 10/1974 | Schafer | 123/470 |
| 3,993,030 | 11/1976 | Jaulmes | 123/470 |
| 4,296,887 | 10/1981 | Hofmann . | |
| 4,487,178 | 12/1984 | Neitz et al. . | |
| 4,506,645 | 3/1985 | Hewlitt | 123/470 |
| 4,528,959 | 7/1985 | Hauser | 123/470 |
| 5,345,913 | 9/1994 | Belshaw | 123/470 |
| 5,878,719 | 3/1999 | Nakagomi | 123/470 |

FOREIGN PATENT DOCUMENTS

| | | | |
|---|---|---|---|
| 204195 | 3/1955 | Australia | 123/470 |
| 0294586 | 12/1988 | European Pat. Off. | 123/470 |
| 873011 | 4/1953 | Germany . | |
| 188969 | 3/1957 | Germany | 123/470 |
| 3004033 | 2/1980 | Germany . | |
| 3000061 | 7/1981 | Germany . | |
| 404086368 | 3/1992 | Japan | 123/470 |

OTHER PUBLICATIONS

Patent Abstracts of Japan, vol. 16, No. 321, Jul. 14, 1992, M–1279, JP 4–91362(A), Publ. Mar. 24, 1992.

*Primary Examiner*—Carl S. Miller
*Attorney, Agent, or Firm*—Evenson, McKeown, Edwards & Lenahan, P.L.L.C.

[57] ABSTRACT

A fuel injection nozzle for injecting fuel onto the combustion space of an internal combustion engine has a shielding sleeve assigned to its nozzle neck. This shielding sleeve is coordinated with a nozzle receptacle so that the shielding sleeve is secured in position in the cylinder head.

14 Claims, 1 Drawing Sheet

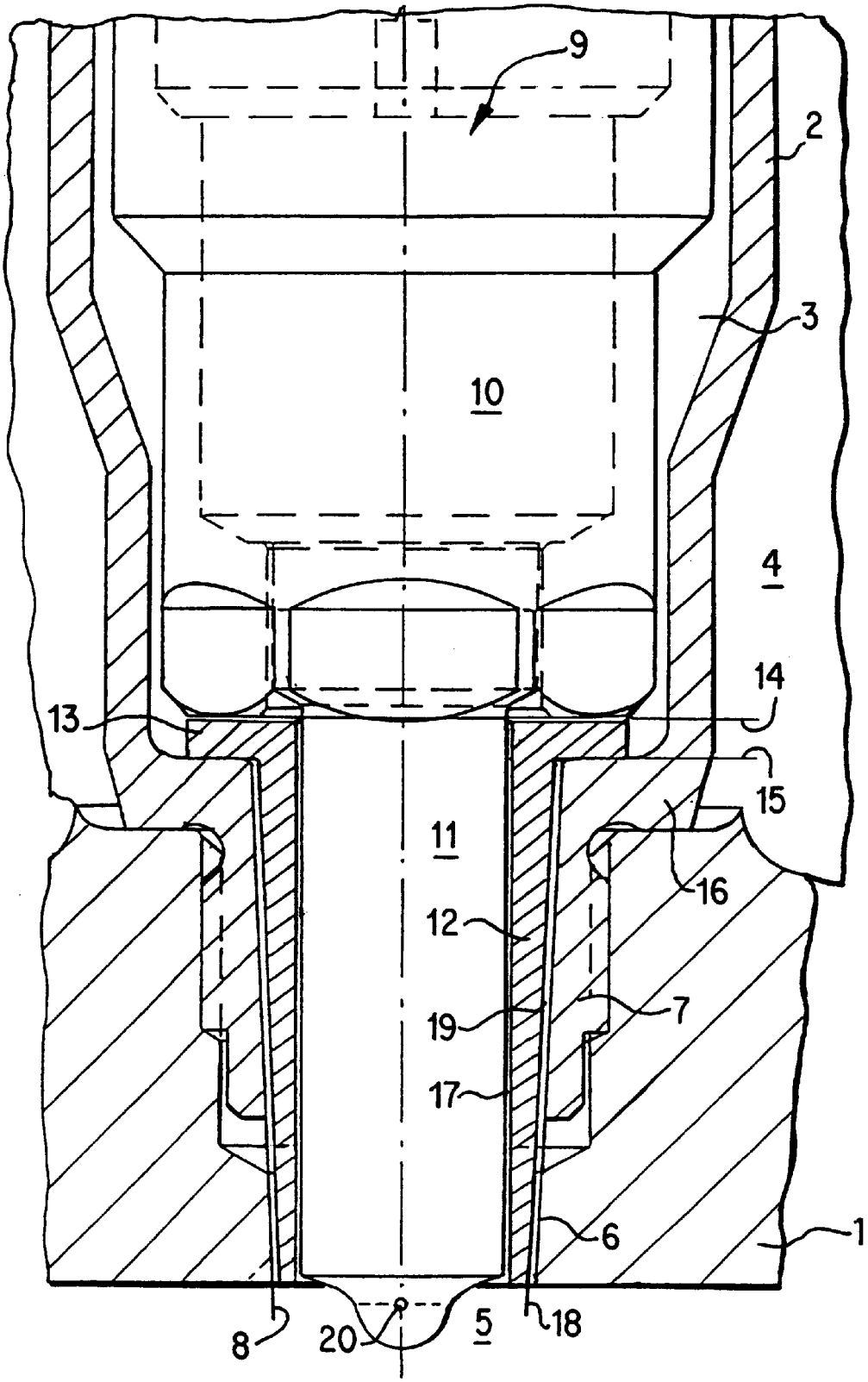
9
2
3
10
4
14
13
15
11
16
12
7
19
17
6
1
8
20
5
18

FUEL INJECTION NOZZLE INJECTING ONTO THE COMBUSTION SPACE OF AN INTERNAL COMBUSTION ENGINE

CROSS REFERENCE TO RELATED APPLICATION

This application is related to application Ser. No. 09/384,027 filed on Aug. 26, 1999 in the name of Erich JEHLE et al. for FUEL INJECTION NOZZLE INJECTING ONTO THE COMBUSTION SPACE OF AN INTERNAL COMBUSTION ENGINE.

BACKGROUND OF THE INVENTION

This application claims the priority of 198 38 748.2, filed Aug. 26, 1998, the disclosure of which is expressly incorporated by reference herein.

The present invention relates to a fuel injection nozzle injecting onto the combustion space of an internal combustion engine. More particularly, it relates a nozzle which injects fuel onto a combustion space of an internal combustion engine, configured to be surrounded in a nozzle receptacle located on the same side as the internal combustion engine and to be open towards the combustion space, comprising a nozzle body. A nozzle neck is offset to the nozzle body. An injection orifice is arranged at an end of the neck located on a combustion-space side, and a shielding sleeve radially overlaps the nozzle neck to delimit an annular gap relative to the nozzle neck. With the nozzle in a mounting position, a radial clearance is defined relative to the surrounding nozzle receptacle. The nozzle is insertable into the nozzle receptacle in a direction of the combustion space and, with the nozzle mounted position, the shielding sleeve being axially clamped, with an annular collar provided at an end thereof facing the nozzle body, between the nozzle body and nozzle receptacle in a region of the beginning of the neck.

Fuel injection nozzles are known in many forms. German Patent Specification 873 011 shows various configurations of fuel injection nozzles in which the nozzle neck is assigned a shielding sleeve which, via an annular collar provided at its end facing the nozzle body, is braced between the nozzle body and nozzle receptacle.

Moreover, in some known embodiments, the shielding sleeve is radially braced relative to the nozzle neck on part regions of the latter. Due to the direct connection with the combustion space, the shielding sleeve, like the nozzle neck, which has al least one injection orifice on the combustion-space side, is exposed to high thermal and also mechanical loads as a result of the extreme temperature and pressure fluctuations occurring when the internal combustion engine is in operation.

Particularly when the shielding sleeve is at least partially free relative to the nozzle neck surrounded thereby and, because of the given dimensions of the gap in relation to the nozzle neck, on one hand, and to the nozzle receptacle, on the other hand, is also exposed to different load pressures according to the pressure fluctuations in the combustion space, the loads acting on the shielding sleeve can even assume extreme values. Ultimately, these values may cause fatigue fractures leading to fracturing of the shielding sleeve.

There is, therefore, the risk that a part of the shielding sleeve which is remote from the annular collar in the direction of the combustion space loses its connection with the nozzle and falls into the combustion space, especially when the shielding sleeve has a thin-walled configuration over part regions of the nozzle neck, with corresponding transitions to regions of greater wall thickness, thus, for example, in the region of the transition to the annular collar.

If parts of the shielding sleeve enter the combustion space, serious damage to the internal combustion engine usually results. This is also the case of other foreign bodies entering the combustion space, if only in view of the small free spaces available at least in the top dead center position.

SUMMARY OF THE INVENTION

An object of the present invention is to avoid change to the internal combustion engine.

According to the invention, this object has been by providing that in relation to the mounting position of the nozzle, the shielding sleeve has, in an axial region running towards the annular collar, an outer contour which, at least over a part region of its circumference, radially undercuts the inner contour of the nozzle receptacle in an axial region offset in the direction of the combustion space. This ensures that the shielding sleeve cannot fall into the combustion space at least as long as its sleeve-shaped basic structure is still present, which will usually be the case.

If the broken-off part preserves the sleeve structure, the broken-off part of the sleeve cannot, in any case, fall into the combustion space when there is a positive overlap with the cross section of the nozzle receptacle in the direction of the combustion space. The overlap may be restricted to part regions of the circumference and, according to the invention, is achieved in the simplest way in that a radial widening of the nozzle receptacle corresponds to a radial widening of the sleeve.

According to the invention, a particularly simple structure is achieved if the sleeve is widened conically with respect to its outer circumference in the direction of its annular collar, along with a corresponding conical widening of the nozzle receptacle to the side facing away from the combustion space. The conical widening may be restricted to portions of the nozzle circumference which are assigned corresponding widening portions on the nozzle receptacle.

The conical widening can also be achieved by corresponding axially successive steps, that is to say may also take place in step form. According to the present invention, the radial overlap can be effected by providing only one step jump, specifically with wall profiles which are otherwise cylindrical.

The radial widening provided on the outer circumference Of the shielding sleeve can, according to the invention, correspond to a widening of the inside diameter, so that, for example, a conical and/or stepped profile on the outer circumference of the sleeve is not associated with any corresponding thickenings of material, but only with widenings of the annular gap between the shielding sleeve and nozzle neck. These widenings are not particularly detrimental to the desired insulating function of the sleeve when the annular gap located on the combustion-space side between the shielding sleeve and the nozzle neck is correspondingly small or approaches zero.

If it is assumed that the shielding sleeve is at especially high risk particularly at the transition to the annular collar, it proves sufficient for a radial overlap acting as a safeguard against loss to be provided only in that region of the shielding sleeve which is remote from the combustion space. If, on account of the sleeve structure and/or the load conditions in the region nearer the combustion space, there is a corresponding risk of fracture or breakage, then it is advantageous to provide the corresponding overlap even in the axial region nearer the combustion space.

Particularly in a case of this type, an overlap produced by appropriate stepping on the outer circumference of the shielding sleeve proves expedient, while a corresponding radially inner stepping can correspond to this radially outward stepping of the shielding sleeve.

The configuration according to the present invention of the shielding sleeve can be expedient with shielding sleeves consisting both of steel and, in particular, of highly heat-conductive materials such as, in particular, copper or copper alloys. Wall thicknesses within the range of about one tenth of the nozzle-neck diameter and, in part, considerably smaller than 1 mm, at least in part regions, are used for the sleeve.

The configuration of the shielding sleeve according to the invention still has no influence on the mounting of the nozzle, because the radial widenings are provided opposite to the push-in direction of the injection nozzle during mounting, i.e. as the distance from the combustion space increases.

BRIEF DESCRIPTION OF THE DRAWINGS

Other objects, advantages and novel features of the present invention will become apparent from the following detailed description of the invention when considered in conjunction with the accompanying drawings.

The sole FIGURE is a sectional elevational view of a portion of a fuel injection nozzle in accordance with the present invention and opening out onto the combustion space of an internal combustion engine.

DETAILED DESCRIPTION OF THE DRAWINGS

A portion of a cylinder head 1 is shown which is located on the combustion-space side and into which is screwed an insert sleeve 2 which delimits a nozzle receptacle 3 relative to the water space 4 of the cylinder head 1. In an end region facing the combustion space 5 and adjoining the insert sleeve 2, the nozzle receptacle 3 is formed by a wall portion 6 of the cylinder head 1. This wall portion 6 forms, together with that portion 7 of the insert sleeve 2 which is screwed into that region of the cylinder head 1 which is located on the combustion-space side, the inner contour 8 of that region of the nozzle receptacle 3 over which the partially shown injection nozzle, designated generally by reference numeral 9, extends with its nozzle neck 11 which axially adjoins the nozzle body surrounded by the nozzle holder, jointly designated below as the nozzle body 10.

The nozzle neck 11 is offset radially inwards relative to the nozzle body 10. The nozzle neck 11 is assigned a shielding sleeve 12 which, at its end remote from the combustion space 5, has an annular collar 13 which is located in the transitional region between the nozzle body 10 and nozzle neck 11. When the nozzle body 10 is braced axially relative to the cylinder head 1 in the direction of the combustion space 5, the collar 13 lies between the radial bearing surface 14, formed by the radial offset of the nozzle body 10 at the transition to the nozzle neck 11, and the bearing surface 15, which is formed by an offset 16 of the insert sleeve 2 at the transition to that portion 7 of the latter which is screwed into the cylinder head 1.

In the illustrated embodiment, the shielding sleeve 12, over its entire length, surrounds the nozzle neck 11 with a clearance, so as to form an annular gap 17. The shielding sleeve 12 is surrounded radially on the outside, with a clearance, by the wall portion 6 of the cylinder head 1 and the portion 7 of the insert sleeve 2. The two portions 6, 7 determine the inner contour 8 of the nozzle receptacle 3, and the inner contour is continuous, widening conically to the side facing away from the combustion space 5 and being overlapped by the shielding sleeve 12. The latter has an outer contour 18 running correspondingly to the inner contour 8 and widening conically in the direction of the annular collar 13.

The conicity of the outer and inner contours is defined such that, as seen axially from the combustion space 5 in the direction of the annular collar 13, the inner contour 8 and outer contour 18 overlap radially, so that, on the assumption that the shielding sleeve 12 is displaced in the direction of the combustion space 5 after being separated from the annular collar 13, the outer contour 18 would run onto the inner contour 8. The possible length over which that part of the shielding sleeve 12 which has come loose from the annular collar 13 is displaced relative to the cylinder head 1 can be determined via the width of the annular gap 19 between the outer contour 18 and inner contour 8 and the amount of conicity.

Thus, by a simple construction, the present invention makes it possible, without any contact, to protect the shielding sleeve 12 from falling into the combustion space 5, should the shielding sleeve 12 break off due to thermal and/or mechanical loads and corresponding material failure below or at the transition to the annular collar 13.

The specific embodiment illustrated serves merely to explain the present invention, but in no way signifies a restriction of the invention to the embodiment apparent from the illustration. Thus, within the scope of the invention, for example, a corresponding radial overlap can be provided between the outer contour 18 of the shielding sleeve 12 and the inner contour 8 of the insert sleeve 2 by giving the shielding sleeve 12 and/or the corresponding axial portion of the insert sleeve 2 or the inner contour 8 of the nozzle receptacle 3 a stepped design. In such case, one or more steps may be provided, and the transitions between the steps may run cylindrically.

Contrary to the exemplary embodiment shown, the inner contour of the shielding sleeve 12 may follow the profile of its outer contour 18. The profile is chosen with regard to the intended overlapping, so that, if appropriate, the annular gap 17 widens to the side facing away from the combustion space 5.

Only partial regions of the shielding sleeve 12 can be configured conically with respect to their outer contour 18. Thus, for example, the end region located on the combustion-space side can be so configured, so that overlap is ensured in this region, and there is thus no possibility of the shielding sleeve 12 or of parts thereof falling into the combustion space 5.

In order to better explain and understand the invention, the illustrated embodiment is based on a rotationally symmetrical configuration of the respective contours, specifically of the inner contour 8 and outer contour 18. Of course, it is within the scope of the invention, for only portions over the circumference to be configured so as to produce an overlap.

Within the scope of the invention, the shielding sleeve 12 can, furthermore, also be configured such that it axially secures the nozzle neck 11, too, for example by engaging axially under the nozzle neck 11 at the end of the latter which is assigned to the combustion space 5 and which contains the injection orifice 20. In conjunction with a solution of this kind or one functionally corresponding thereto, a configuration according to the invention which results in a radial overlap of the shielding sleeve 12 and insert sleeve 2 or cylinder head 1 achieves retention securing not only for the shielding sleeve 12, but also for the nozzle neck 11, should the nozzle 9 be fractured when it is inserted into the cylinder head 1.

Within the scope of the invention, the shielding sleeve 12 can be a steel sleeve, but is preferably formed from materials of high thermal conductivity such as, for example, copper. Also within the scope of the invention, the wall thickness for the shielding sleeve 12 preferably amounts to only a fraction of the diameter of the nozzle neck 11 and therefore is, for example, of the order of magnitude of less than one millimeter.

The widths of the annular gaps are correspondingly also on the orders of magnitude preferably in the tenths of a millimeter range, e.g. about 0.5 mm. In relation to annular gaps with dimensions of this kind, conicities of up to approximately 3°, preferably approximately between 1° and 2°, prove advantageous or step widths corresponding to such conicities in the case of a radial overlap achieved by one or more steps.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fuel injection nozzle which injects fuel onto a combustion space of an internal combustion engine, configured to be surrounded in a nozzle receptacle located on the same side as the internal combustion engine and to be open towards the combustion space, comprising a nozzle body, a nozzle neck offset to the nozzle body, an injection orifice arranged at an end of the neck located on a combustion-space side, a shielding sleeve radially overlapping the nozzle neck to delimit an annular gap relative to the nozzle neck and, with the nozzle in a mounting position, to define a radial clearance relative to the surrounding nozzle receptacle, the nozzle being insertable into the nozzle receptacle in a direction of the combustion space and, with the nozzle in the mounted position, the shielding sleeve being axially clamped, and an annular collar provided at an end thereof facing the nozzle body, between the nozzle body and nozzle receptacle in a region of the beginning of the neck, wherein, in relation to the mounting position of the nozzle, the shielding sleeve has, in an axial region extending toward the annular collar, an outer contour which, at least over a circumferential portion thereof, radially undercuts an inner contour of the nozzle receptacle in an axial region offset in the direction of the combustion space, wherein the axial region having the outer contour is separate from the annular collar.

2. The fuel injection nozzle according to claim 1, wherein the outer contour of the shielding sleeve widens conically, at least in portions, toward the annular collar.

3. The fuel injection nozzle according to claim 1, wherein the outer contour of the shielding sleeve widens in at least one step toward the annular collar.

4. The fuel injection nozzle according to claim 1, wherein the inner contour of the nozzle receptacle tapers conically, at least partially, toward the combustion space.

5. The fuel injection nozzle according to claim 1, wherein the inner contour of the nozzle receptacle tapers at least in one step toward the combustion space.

6. The fuel injection nozzle according to claim 1, wherein that region of the inner contour of the nozzle receptacle which overlaps with the outer contour of the shielding sleeve is axially adjacent the combustion space.

7. The fuel injection nozzle according to claim 6, wherein a distance of a region of the inner contour of the nozzle receptacle which overlaps the outer contour of the shielding sleeve from the combustion space corresponds at least approximately to one eighth of the length of the shielding sleeve.

8. The fuel injection nozzle according to claim 1, wherein a region of the inner contour of the nozzle receptacle which overlaps the outer contour of the shielding sleeve is located axially in a longitudinally middle region of the shielding sleeve.

9. The fuel injection nozzle according to claim 1, wherein a region of the inner contour of the nozzle receptacle which overlaps the outer contour of the shielding sleeve is axially adjacent the annular collar.

10. The fuel injection nozzle according to claim 1, wherein the inner contour of the shielding sleeve has a profile corresponding approximately to the outer contour thereof.

11. The fuel injection nozzle according to claim 1, wherein the inner contour of the shielding sleeve has a cylindrical profile.

12. The fuel injection nozzle according to claim 1, wherein the inner contour of the shielding sleeve has at least one step.

13. The fuel injection nozzle according to claim 12, wherein the inner contour of the shielding sleeve has a profile corresponding approximately to the outer contour thereof.

14. The fuel injection nozzle according to claim 13, wherein a region of the inner contour of the nozzle receptacle which overlaps the outer contour of the shielding sleeve is axially adjacent the annular collar.

* * * * *